US010278237B2

(12) United States Patent
Krause et al.

(10) Patent No.: US 10,278,237 B2
(45) Date of Patent: Apr. 30, 2019

(54) METHOD FOR PRODUCING A HEATING SYSTEM ON A 3D PLASTIC WINDOW

(71) Applicant: inpro Innovationsgesellschaft für fortgeschrittene Produktionssysteme in der Fahrzeugindustrie mbH, Berlin (DE)

(72) Inventors: Thomas Krause, Berlin (DE); Olaf Hoyer, Oberkrämer (DE); Henning Gleich, Duisburg (DE)

(73) Assignee: INPRO INNOVATIONSGESELLSCHAFT FÜR FORTGESCHRITTENE PRODUKTIONSSYSTEME IN DER FAHRZEUGINDUSTRIE MBH, Berlin (DE)

( * ) Notice: Subject to any disclaimer, the term of this patent is extended or adjusted under 35 U.S.C. 154(b) by 179 days.

(21) Appl. No.: 15/201,645

(22) Filed: Jul. 5, 2016

(65) Prior Publication Data

US 2017/0006666 A1 Jan. 5, 2017

(30) Foreign Application Priority Data

Jul. 5, 2015 (DE) ..... 10 2015 008 838

(51) Int. Cl.
*H05B 3/00* (2006.01)
*H05B 3/84* (2006.01)
(Continued)

(52) U.S. Cl.
CPC ..... *H05B 3/84* (2013.01); *B41M 1/12* (2013.01); *B41M 1/22* (2013.01); *H05B 2203/017* (2013.01)

(58) Field of Classification Search
CPC ..... H05B 3/84; H05B 2203/017; B41M 1/12; B41M 1/22
See application file for complete search history.

(56) References Cited

U.S. PATENT DOCUMENTS 4,450,346 A 5/1984 Boaz
4,453,669 A * 6/1984 Karla ..... H05B 3/84 165/43
(Continued)

FOREIGN PATENT DOCUMENTS

DE 69607405 T2 12/2000
DE 10344023 B4 6/2006
(Continued)

*Primary Examiner* — Paul D Kim
(74) *Attorney, Agent, or Firm* — Seppo Laine Oy

(57) ABSTRACT

A method for producing a heating system on a 3D plastic window, such as a car window. The heating system having an electric heat conductor structure with at least two bus bars and a grid line pattern with a plurality of grid lines. The method having: a step in which the two bus bars, made of a first electrically conductive paste are screen-printed onto the window by a displaceable squeegee; a step in which the grid line pattern is applied onto the window such that it respectively overlaps the two bus bars with at least one second electrically conductive paste which has a greater electrical resistance than the first electrically conductive paste, and a final step in which the two bus bars and the grid lines overlapping these bus bars are at the respective overlapping points electrically connected into the electric heat conductor structure by means of electrical connectors.

23 Claims, 7 Drawing Sheets

(51) Int. Cl.
*B41M 1/12* (2006.01)
*B41M 1/22* (2006.01)

(56) References Cited

U.S. PATENT DOCUMENTS

| | | | | | |
|---|---|---|---|---|---|
| 5,766,739 | A * | 6/1998 | Funaki | H05B 3/84 | 219/203 |
| 6,014,840 | A * | 1/2000 | Ray | B60J 1/1853 | 49/360 |
| 6,024,904 | A | 2/2000 | Nanri | | |
| 6,239,758 | B1 * | 5/2001 | Fuchs | H01Q 1/1278 | 343/704 |
| 7,129,444 | B2 * | 10/2006 | Weiss | H05B 3/84 | 219/203 |
| 9,393,774 | B2 * | 7/2016 | Kim | B41F 15/423 | |
| 9,796,362 | B2 * | 10/2017 | Schwenke | B60S 1/586 | |

FOREIGN PATENT DOCUMENTS

| | | | |
|---|---|---|---|
| DE | 10362093 | B4 | 2/2009 |
| DE | 102008015853 | A1 | 10/2009 |
| DE | 202012104631 | U1 | 1/2013 |
| EP | 0281351 | A1 | 9/1988 |
| EP | 1967042 | B1 | 2/2012 |
| FR | 2448335 | A1 | 9/1980 |

* cited by examiner

METHOD FOR PRODUCING A HEATING SYSTEM ON A 3D PLASTIC WINDOW

FIELD

The present invention relates to a method for producing a heating system on a 3D plastic window such as a car window of plastic, comprising an electric heat conductor structure consisting of at least two bus bars (principal heat conductors) and a grid line pattern with a plurality of grid lines (branch heat conductors).

BACKGROUND

DE 10 2008 015 853 A1 discloses a method for producing a heatable plastic window for motor vehicles with at least one plastic layer, wherein at least one heat conductor is printed onto the inner side of the plastic layer, preferably in a 3D screen-printing process. In this method, the plastic layer is made available in the form of a film, a sheet or an injection-moulded part. In order to print on the heat conductor, a monofilament polyester fabric is used as screen-printing fabric and an electrically conductive paste with metal particles, preferably silver particles, is used as screen-printing ink. After the heat conductor has been printed on, the plastic layer is heat-treated and/or deformed. The 3D screen-printing process is carried out on a curved surface on the inner side of the plastic layer, wherein two bus bars (principal heat conductors) are laterally arranged on the right and the left side of the plastic window and several grid lines (branch heat conductors), which are electrically connected to the two bus bars, horizontally extend essentially in a straight line and parallel to one another. The plastic layer of the plastic window is essentially made of polycarbonate, polymethylmethacrylate, polymethylmethacrylimide or cycloolefin copolymers.

Conventional screen-printing devices are suitable for printing plane objects such as, e.g., plane car window panes, wherein the strip conductors of a rear-window defroster are applied onto a plane car window pane, e.g., by means of screen printing. After the strip conductors have been printed on, the window pane is heated and bent while the ink printed on simultaneously cures.

A squeegee with an elastic application element and a holding device for screen-printing arbitrarily curved surfaces is disclosed in DE 103 44 023 B4, wherein the holding device is viewed over the width of the squeegee divided into several holding sections that can be moved relative to one another and a guide plate, which rests against the application element at least during the printing process, originates from each holding section. Due to the division into several holding sections that can be moved relative to one another, the squeegee can be adapted to differently curved surfaces of an object to be printed. The guide plates furthermore ensure a uniform pressure distribution over the pressing edge of the application element.

Furthermore, DE 103 62 093 B4 discloses a screen-printing method for printing curved surfaces with the following steps: reading in a surface contour of an object to be printed, storing the read-in surface structure in a central control unit, generating control commands by means of the control unit and aligning a printing unit during the printing process by means of actuators that are activated by the control commands as a function of the surface geometry of the object to be printed, as well as the position of the squeegees relative to the object to be printed, and thereby constantly holding a printing unit frame relative to the object to be printed during a printing motion of the squeegees in an imaginary contact line between squeegee and the object to be printed.

SUMMARY OF THE INVENTION

The present invention is based on the objective of realizing the series production of a heating system on a 3D plastic window such as a 3D car window of plastic in an exactly defined, flexible and cost-effective fashion.

In order to attain this objective, according to a first aspect of the invention, there is provided a method for producing a heating system on a 3D plastic window such as a car window of plastic, comprising an electric heat conductor structure consisting of at least two bus bars (principal heat conductors) and a grid line pattern with a plurality of grid lines (branch heat conductors), comprising

- a step, in which the two bus bars are respectively screen-printed onto the 3D plastic window, preferably on the edges of the latter, by means of at least one displaceable squeegee with screen-printing ink consisting of a first electrically conductive paste, preferably a first silver paste,
- a step, in which the grid line pattern is applied onto the 3D plastic window such that it respectively overlaps the two bus bars with at least one second electrically conductive paste, preferably a second silver paste, which has a greater electrical resistance than the first electrically conductive paste, and
- a final step, in which the two bus bars and the grid lines overlapping these bus bars are at the respective overlapping points electrically connected into the electric heat conductor structure by means of electrical connectors.

According to an embodiment, the silver paste used for applying the grid lines of the grid line pattern onto the 3D plastic window has a higher content of carbon particles than the silver paste used for printing the bus bars onto the 3D plastic window.

According to another embodiment, the step, in which the bus bars are applied onto the 3D plastic window, is offset in time referred to the step, in which the grid line pattern is applied onto the 3D plastic window.

In an embodiment, the step, in which the bus bars are applied onto the 3D plastic window, may also be carried out prior to the step, in which the grid line pattern is applied onto the 3D plastic window, or the step, in which the grid line pattern is applied onto the 3D plastic window, may be carried out prior to the step, in which the bus bars are applied onto the 3D plastic window.

In another embodiment, the grid line pattern may likewise be screen-printed onto the 3D plastic window by means of at least one displaceable squeegee. In addition, the bus bars may be applied onto the 3D the plastic window by means of at least one first displaceable squeegee and/or the grid lines of the grid line pattern may be applied by means of at least one second displaceable squeegee. However, the two bus bars and/or the grid lines of the grid line pattern may also be applied onto the 3D plastic window by means of one squeegee that prints in two directions and/or two squeegees that operate in different directions. Furthermore, the grid line pattern may be applied onto the 3D plastic window by means of dispensing or by utilizing a digital inkjet printer.

According to an embodiment, the two bus bars of the heat conductor structure are simultaneously applied on the left and on the right side of the 3D plastic window in the region of the grid line pattern due to the combination of a feed motion and a rotational motion of the at least one squeegee.

According to another embodiment, the screen-printing of the heat conductor structure consisting of the two bus bars and the grid lines overlapping these bus bars may be respectively carried out with one of two screens that are used offset in time, wherein the two bus bars are applied onto the 3D plastic window along the edges of the latter with the corresponding screen and with separately displaceable squeegees.

In an embodiment, the two screens, by means of which the heat conductor structure consisting of the bus bars and the grid lines overlapping these bus bars is screen-printed onto the 3D plastic window, are inserted into the upper unit of a screen-printing machine in succession.

In another embodiment, instead of using one screen for screen-printing the two bus bars of the heat conductor structure to be produced onto the 3D plastic window, it is also possible to use two screens with smaller dimensions, each of which is inserted into the upper unit of the screen-printing machine or guided by a robot or position-controlled for the respective application of one of the two bus bars.

According to an embodiment, the at least one displaceable squeegee used for applying the grid line pattern onto the 3D plastic window is a squeegee that prints in two directions and, starting at the beginning of the first grid line of the grid line pattern, prints the second electrically conductive paste onto the 3D plastic window in the feed direction such that the first grid line of the grid line pattern is formed, wherein the squeegee then carries out a rotational motion after it reaches the end of the first grid line of the grid line pattern referred to the feed direction and subsequently prints the second electrically conductive paste onto the 3D plastic window in the direction extending opposite to the feed direction such that the second grid line of the grid line pattern is formed, wherein this process is repeated until the complete grid line pattern is formed on the 3D plastic window.

According to a second aspect of the invention, the objective of the invention is also attained with a method for producing a heat conductor system on a 3D plastic window such as a car window of plastic, comprising an electric heat conductor structure consisting of at least two bus bars (principal heat conductors) and a grid line pattern with a plurality of grid lines (branch heat conductors), comprising a step, in which the two bus bars and the grid lines of the grid line pattern are respectively screen-printed onto the 3D plastic window such that they overlap one another by means of at least one displaceable squeegee with screen-printing ink consisting of only one electrically conductive paste, preferably a silver paste, and a subsequent step, in which the two bus bars and the grid lines overlapping these bus bars at the respective overlapping points electrically connected into the electric heat conductor structure by means of electrical connectors.

According to an embodiment, in this case, the screen-printing of the two bus bars and the grid line pattern with screen-printing ink in the form of the silver paste is carried out continuously by means of a displaceable squeegee capable of printing in opposite directions, wherein this squeegee prints the grid lines of the grid line pattern onto the 3D plastic window starting from the left or the right side with a respective rightward or leftward directed feed motion in a region with less curvature of the 3D plastic window for the grid line pattern, and wherein the feed motion of said squeegee respectively transforms into a rotational and pivoting motion and the squeegee continuously screen-prints one of the two respective bus bars onto the 3D plastic window such that it overlaps the grid lines of the applied grid line pattern in regions with more significant curvature of the 3D plastic window for the two bus bars.

According to another embodiment, instead of using the displaceable squeegee capable of printing in opposite directions, it would also be possible to use two squeegees that operate in different directions and the feed motions of which respectively need to be transformed into a rotational and the pivoting motion.

In an embodiment, after the respective application of the grid lines of the grid line pattern and/or one of the two bus bars, it is ensured that the electrically conductive paste printed onto the 3D plastic window can become touch-dry, preferably by means of self-drying, or is thermally cured by means of IR-radiation or heat transmission.

In another embodiment, the transformations from the feed motion of the at least one squeegee to the rotational and the pivoting motion or vice versa are preferably program-controlled. The two bus bars and the grid lines of the grid line pattern can be joined at the overlapping points by means of a conductive adhesive or by means of soldering.

The number of respective steps of three variations of the method according to the invention are compared below in table 1.

TABLE 1

| Steps | Variation 1 | Variation 2 | Variation 3 |
|---|---|---|---|
| | Complete screen-printing with one silver paste | Dual Printing with two silver pastes | Combined screen-printing and dispensing |
| 1 | cleaning component | cleaning component | cleaning component |
| 2 | ionizing component | ionizing component | ionizing component |
| 3 | positioning component | positioning component | positioning component |
| 4 | lowering upper unit | lowering upper unit | lowering upper unit |
| 5 | flooding screen | flooding screen with silver paste for grid lines | partial flooding with silver paste for bus bars in the region of the bus bars (optionally 2 floodbars) |
| 6a | screen-printing with squeegee starting from the left or right side with a respective rightward or leftward directed feed motion in the less curved grid lines region | printing the grid lines | printing right and left bus bars simultaneously (2 squeegees) |
| 6b | more significantly curved bus bar region is printed after the transformation from feed motion to rotational motion | | |
| 7 | raising upper unit | raising upper unit | raising upper unit |
| 8 | optional drying with IR, heat transmission, etc. | optional drying with IR, heat transmission, etc. | removing component |
| 9 | afterflooding for pattern completion | transporting component to "sister screen" | transporting component to dispensing station |
| 10 | lowering upper unit | positioning in "sister screen" | positioning component |
| 11 | feed motion and transformation to rotational motion for second bus bar | lowering upper unit | applying grid lines by means of dispensing |
| 12 | raising upper unit removing component | flooding screen with bus bar silver paste in bus bar regions | removing component |

TABLE 1-continued

| Steps | Variation 1 | Variation 2 | Variation 3 |
|---|---|---|---|
| 13 | curing heating system | printing right and left bus bars simultaneously | curing heating system |
| 14 | | raising upper unit | |
| 15 | | removing component | |
| 16 | | curing heating system | |

Table 1 shows that variation 1 with two-stage squeegee control requires thirteen steps due to the allowance for the edge regions of the 3D plastic window, wherein this number of steps corresponds to that of variation 3, in which the technology of screen-printing and dispensing is combined. However, if two different silver pastes should be used for the application of the bus bars and the grid lines in accordance with variation 2, the number of screen-printing steps increases to sixteen. In variation 3, in which the technology of screen-printing and dispensing is combined, the number of steps is not affected whether one or two silver pastes are used. In this context, only the logistics with respect to the supply of the two silver pastes are more elaborate.

Initial practical experiences showed that the expenditure of time for variation 1 lies in the range between 1.0 and 1.5 min. The expenditure of time for variation 2 increases to about 2 min due to the separate printing of bus bars and grid lines. The expenditure of time for variation 3, in contrast, is about 4 min due to the technology combination of screen-printing and dispensing. In this case, it should be planned to provide 3-4 more dispensing stations than screen-printing machines in order to achieve a coordinated process sequence.

The screen-printing of 3D components requires flexible screens with little prestress in the range of a few N/cm. Polyester monofilaments, as well as polyamide monofilaments, may be used in this case. Polyamide systems are usually very flexible and can be subjected to higher tensile stresses than polyester systems.

Mesh counts of 77-48 proved advantageous for 2D screen-printing on glass. In 3D screen-printing, the mesh counts represent another process parameter that must be adapted in dependence on the complexity of the component to be printed.

With respect to the setting of each screen on the frame, the prestress and homogeneity of the screen, as well as the adjusted angle of the pattern/heating system, are of importance.

The silver pastes used consist of commercially available silver pastes for polymer windows with different electric conductivity.

The size of the silver particles is decisive for the choice of a suitable screen. In this context, it should be observed that the mesh size of the chosen screen fabric is 3-times to 5-times larger than the particles to be printed.

Graduated viscosities require the addition of a solvent in order to lower the adjusted viscosity of the silver pastes. In this case, the solvent used may consist, e.g., of 2-octanol (98%).

The material to be printed may consist of polycarbonate or blend material with scratchproof paint and plasma layer or with scratchproof paint having anti-graffiti properties.

An exemplary parameter set of preferred printing parameters for the basic 3D component are shown below in table 2.

TABLE 2

| Printing parameter | Unit |
|---|---|
| Prestress | 15 N/cm (rather low, standard 20 N/cm) |
| Squeegee speed | 185 mm/s |
| Separation (distance of substrate from screen) | 10 mm (due to low screen prestress of 15 N/cm, otherwise usually up to 4 mm) |
| Squeegee pressure | 2-2.3 bar |
| Squeegee length | 210 mm |
| Squeegee rubber | PU with 60 Shore in front (on screen) and 90 Shore in rear, with radii |
| Squeegee angle | 70° |
| Scraper of floodbar | aluminium |
| Curing | 60 min at 125° (3-times for 20 min in continuous furnace) |

According to a third aspect of the present invention there is also provided a system for carrying out the method according to claim 1 or 9, comprising at least one supply station for cleaned 3D plastic windows, at least one screen-printing machine that is positioned on the outlet side of said supply station and respectively applies the electric heat conductor structure consisting of the two bus bars and the grid line pattern onto the supplied 3D plastic windows, a paternoster furnace that is arranged parallel to the at least one screen-printing machine, a robot station with at least one robot between the outlet of the screen-printing machine and the inlet of the paternoster furnace, wherein the 3D plastic windows with the electric heat conductor structure printed thereon by means of the screen-printing machine are picked up at the outlet of the latter and inserted into the paternoster furnace opposite to the previous processing direction in order to cure the electric conductor structure printed onto the 3D plastic windows, and a depositing station for the 3D plastic windows with cured electric heat conductor structure, which is arranged downstream of the outlet of the paternoster furnace.

Aspects of the present invention furthermore include the option of combining the technology of dispensing and of 3D screen-printing in the production of a heating system on a 3D plastic window such as a car window plastic. In this case, the advantages of the fast and robust screen-printing technique can be combined with the very flexible dispensing technology.

For this purpose, a dispensing unit is positioned between the robot station and the paternoster furnace in a system for carrying out the method according to claim 22, wherein the 3D plastic windows, onto which initially only the two respective bus bars of the electric heat conductor structure are printed in the at least one screen printing machine, are inserted into the inlet of said dispensing unit by means of the at least one robot of the robot station, wherein the grid lines of the grid line pattern are in the dispensing unit applied onto each of the 3D plastic windows inserted therein by means of dispensing such that they overlap the respective bus bars, and wherein the 3D plastic windows, which are respectively provided with the complete heat conductor structure, are picked up and transported to the inlet of the paternoster furnace by means of at least one conveyor belt or at least one additional robot that is respectively positioned between the outlet of the dispensing unit and the inlet of the paternoster furnace.

BRIEF DESCRIPTION OF THE DRAWINGS

The invention is described below with reference to the drawings. In these drawings.

EMBODIMENTS

Figure 1:
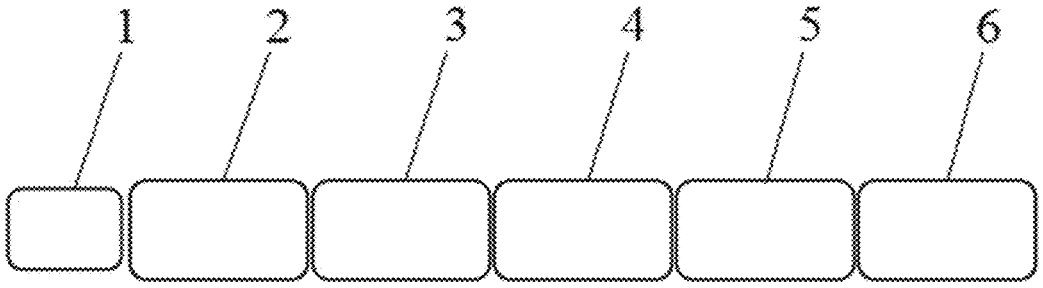
FIG. 1 shows a schematic block diagram of the steps of an embodiment of the method according to the invention, that only utilizes screen-printing.

FIG. 1 shows the sequence of steps of an embodiment of the method according to the invention, that only utilizes screen-printing. In this case, cleaned 3D plastic windows 1 being supplied are fed to at least one screen-printing machine 3 by means of a feed device 2, wherein a heat conductor structure consisting of bus bars and grid lines of a grid line pattern is screen-printed onto the 3D plastic windows 1 by means of said screen-printing machine. On the outlet side of the screen-printing machine 3, the printed 3D plastic windows 1 are received by a removal device 4 and fed to a drying furnace 5 in order to cure the printed electric heat conductor structure. After the latter has dried, the 3D plastic windows 1 are placed into a depositing station 6 arranged downstream of the drying furnace 5.

Figure 2:
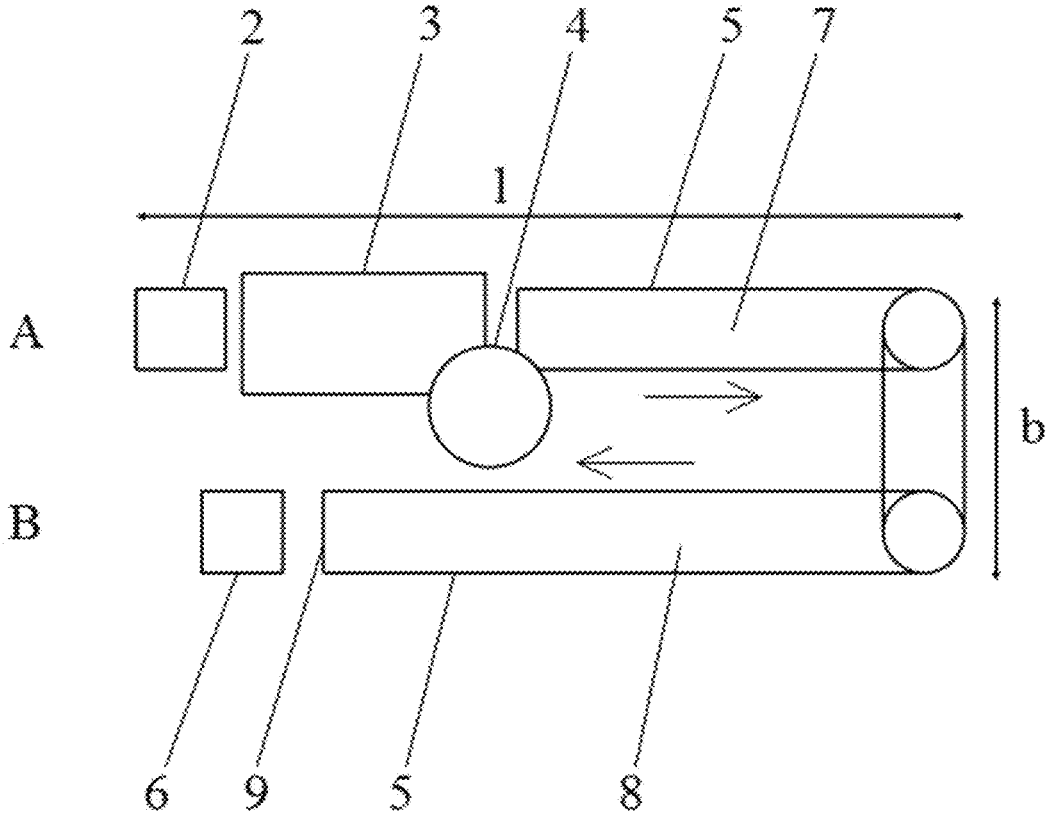
FIG. 2 shows a schematic block diagram of a space-intensive embodiment of the system according to the invention, for carrying out the method according to FIG. 1.

FIG. 2 schematically shows a space-intensive embodiment of a system for carrying out the above-described method, in which the entire machine arrangement is realized in the form of two parallel processing lines due to the relatively long drying zone of the drying furnace 5 on the order of 30 m. In this case, the feed device 2 for the 3D plastic windows 1 and the screen-printing machine 3 arranged downstream thereof are positioned in a first processing line and the removal device 4 in the form of a robot system with at least one robot is positioned between the outlet of the screen-printing machine and the inlet of a first section 7 of the drying zone of the drying furnace 5. A second section 8 of the drying zone of the drying furnace 5, which is longer than the first section 7 of the drying zone, extends with oppositely extending transport direction in the second processing line, wherein the depositing station 6 for depositing the finished 3D plastic windows 1 is arranged in the second processing line downstream of the outlet 9 of the drying furnace 5. The space requirement of this embodiment of the system amounts to approximately 25 m×approximately 7 m.

Figure 3:
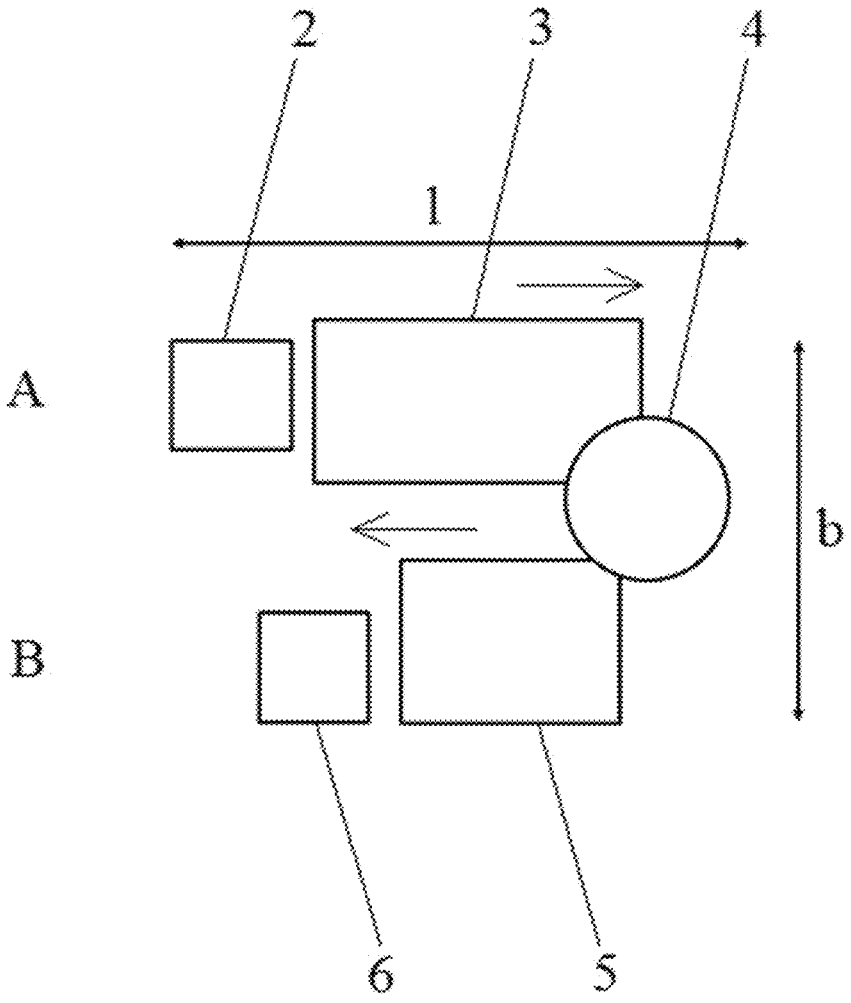
FIG. 3 shows a schematic block diagram of a space-saving embodiment of the isystem according to the invention, for carrying out the method according to FIG. 1.

FIG. 3 schematically shows a space-saving embodiment of the system for carrying out the method, wherein the drying furnace 5 according to FIG. 2 is replaced with a paternoster furnace 12. In this way, the space requirement of the system is reduced to approximately 15 m×approximately 8 m.

Figure 4:
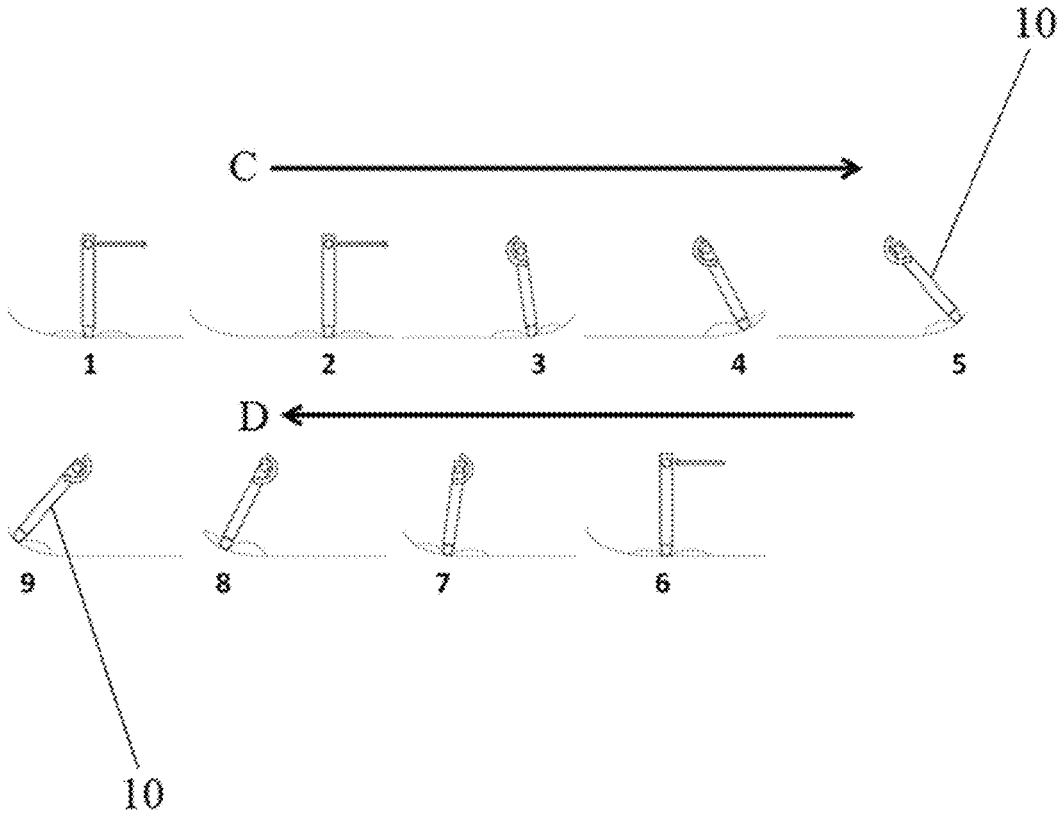
FIG. 4 shows a schematic illustration of the squeegee progression in an embodiment of the method that comprises two steps and in which only one silver paste is used for the bus bars and for the grid lines of the grid line pattern of the electric heat conductor structure to be produced.

FIG. 4 shows an embodiment of the method according to the invention, in which only screen-printing is utilized, wherein this embodiment comprises two steps A (sections number 1-5) and B (sections 6-9) and only one silver paste is used for the bus bars and the grid lines of the grid line pattern of the electric heat conductor structure to be produced. In order to improve the print quality of the electric heat conductor structure on the 3D plastic windows 1, a displaceable squeegee 10 capable of printing in opposite directions or two squeegees that operate in two different directions may be used in this variation of the method.

According to FIG. 4, the displaceable squeegee 10 capable of printing in opposite directions begins the screen-printing of the two bus bars and the grid line pattern with screen-printing ink in the form of the silver paste on the left or the right side in the section 1; 6 with less curvature of the 3D plastic window 1 for the grid line pattern, in which the grid lines of the grid line pattern are continuously printed onto the 3D plastic window 1 with a respectively rightward or leftward directed feed motion. In the sections 5; 9 with more significant curvature of the 3D plastic window 1 for the two bus bars, the feed motion of the squeegee 10 then respectively transforms into a rotational and pivoting motion and said squeegee continuously screen-prints one of the two respective bus bars onto the 3D plastic window 1 such that it overlaps the grid lines of the applied grid line pattern. Subsequently, the two bus bars and the grid lines overlapping these bus bars are at the respective overlapping points electrically connected into the electric heat conductor structure by means of electrical connectors.

If two displaceable squeegees 10 that operate in two different directions are used instead of the one displaceable squeegee 10 capable of printing in opposite directions, the leftward feed motion of the second squeegee 10 on the grid lines of the grid line pattern transforms during the second, oppositely directed step into the rotational and pivoting motion offset in time referred to the first squeegee 10 in order to end at the upper left edge of the 3D plastic window. The transformations from the feed motion of the at least one squeegee 10 to the rotational and pivoting motion or vice versa may respectively take place in a program-controlled fashion.

The two bus bars and the grid lines of the grid line pattern are then joined at the overlapping points by means of a conductive adhesive or by means of soldering.

After the respective application of the grid lines of the grid line pattern and/or one of the two bus bars, it is ensured that the electrically conductive paste printed onto the 3D plastic window 1 can become touch-dry, preferably by means of self-drying, or is thermally cured by means of IR-radiation or UV-radiation or by means of heat transmission.

Figure 5:
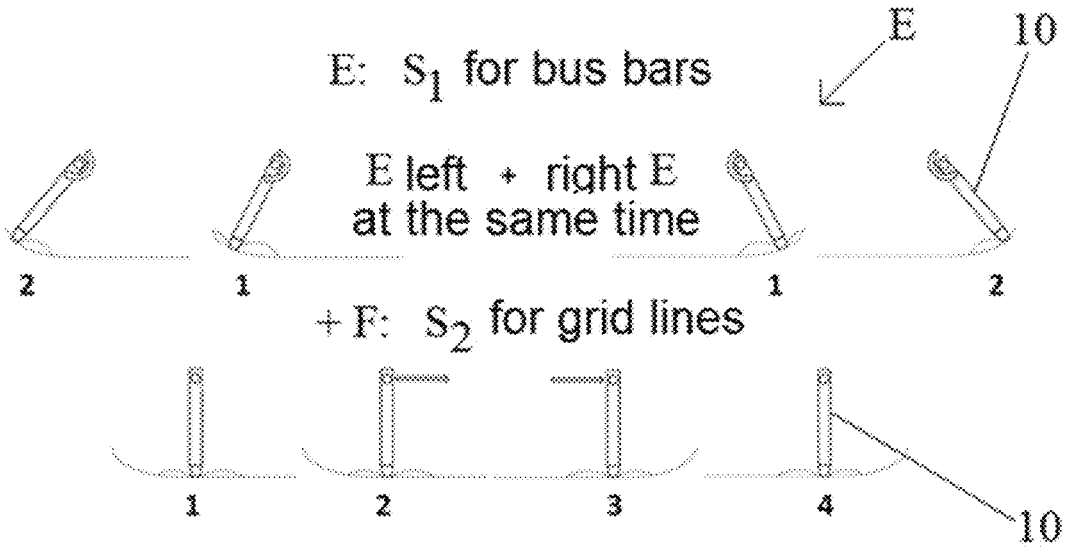
FIG. 5 shows a schematic illustration of the squeegee progression in another embodiment of the method, in which different silver pastes are used for the bus bars and for the grid lines of the grid line pattern of the electric heat conductor structure to be produced.

FIG. 5 shows the squeegee progression of another embodiment of the method according to the invention, in which two different silver pastes are used for the bus bars and for the grid lines of the grid line pattern of the heat conductor structure to be produced. In this two-paste printing process, the bus bars are in step C simultaneously printed on the right and the left side of the 3D plastic window 1 with a first electrically conductive silver paste due to a combined feed motion and rotational motion (sections 1; 2). The grid lines of the grid line pattern are then in step D printed onto the 3D plastic window 1 offset in time with a second silver paste, which has a higher electrical resistance, such that they overlap the bus bars by means of only a feed motion (sections 1-4).

It is important that the respective silver paste printed onto the 3D plastic window 1 is dried after each printing process such that the print pattern cannot smear or stick together. A short holding time of the respective printing process suffices for this purpose. However, the respective silver paste freshly printed onto the 3D plastic window may also be cured by means of heat transmission. UV-curable or IR-curable paste systems may be used as an alternative to thermal curing in order to promote a serial sequence of the printing process.

Figure 6:
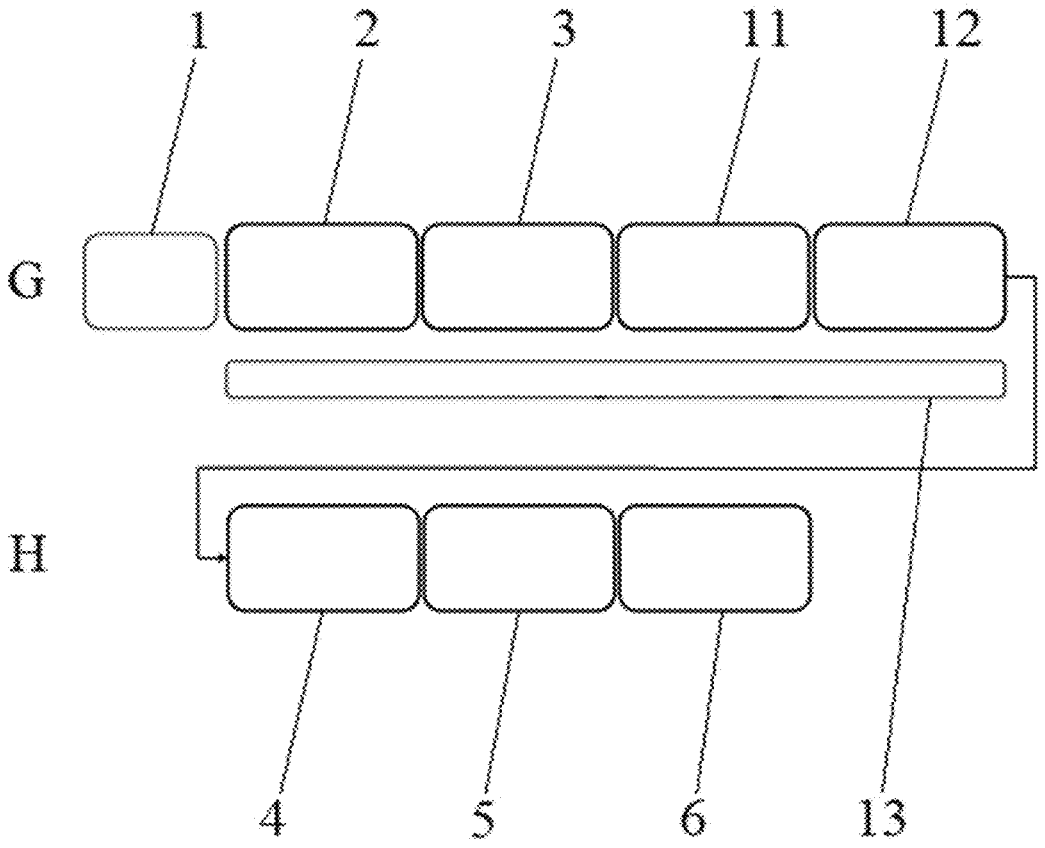
FIG. 6 shows a schematic block diagram of the steps of an embodiment of the method that comprises a combination of screen-printing and dispensing.

FIG. 6 shows a block diagram of steps a-g of another embodiment of the method according to the invention, in which the electric heat conductor structure is produced on a 3D plastic window 1 with a combination of the fast and robust screen-printing technique for the bus bars and the very flexible dispensing technology for the grid lines of the grid line pattern. In this case, the feed device 2 feeds the cleaned 3D plastic windows 1 being supplied to at least one screen-printing machine 3, by means of which the bus bars of the electric heat conductor structure to be produced are screen-printed onto the 3D plastic windows 1 with screen-printing ink in the form of a silver paste. The 3D plastic windows 1 with the bus bars screen-printed thereon are then removed from the screen-printing machine 3 by means of a robot or conveyor system 11 and inserted into a dispensing unit 12 that respectively applies the grid lines of the grid line pattern onto the 3D plastic windows 1 by means of dispensing such that they overlap the bus bars and the electric heat conductor structure is produced. On the outlet side of the dispensing unit 12, the 3D plastic windows are removed by means of a removal device 3 and fed to a drying furnace 5 in order to cure the electric heat conductor structure printed thereon. After the latter has dried, the 3D plastic windows 1 are placed into the depositing station 6 arranged downstream of the drying furnace 5.

Figure 7:
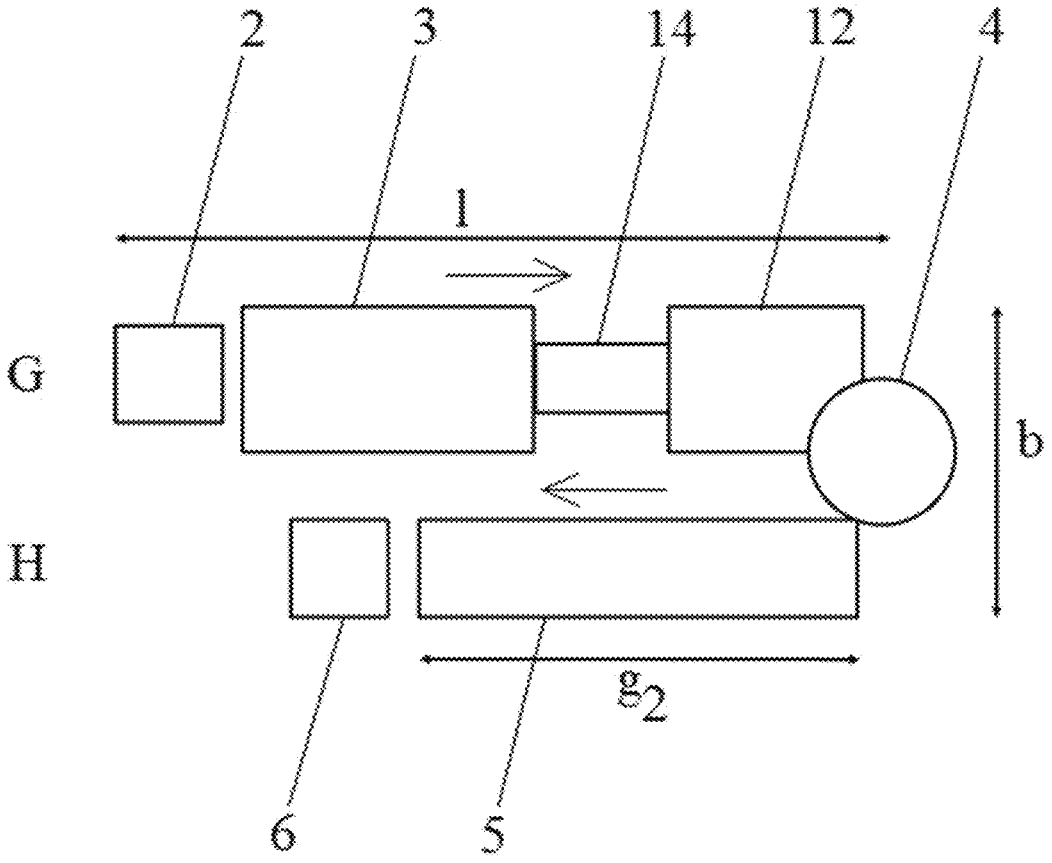
FIG. 7 shows a schematic block diagram of a space-intensive embodiment of the system according to the invention, for carrying out the method according to FIG. 6.

FIG. 7 shows a schematic block diagram of a space-intensive embodiment of the system according to the invention, for carrying out the method according to FIG. 6. Analogous to FIG. 2, the entire machine arrangement is in this case also realized in the form of two parallel processing lines with opposite transport directions. The space requirement of this embodiment of the system amounts to approximately 20 m×approximately 6 m.

In this embodiment, the feed device 2 for the 3D plastic windows 1 and the screen-printing machine 3 arranged downstream thereof are positioned in the first processing line and the conveyor or robot unit 4, by means of which the 3D plastic windows 1 with the bus bars printed thereon are removed from the screen-printing machine 3 and inserted into the dispensing unit 12, is positioned between the outlet of the screen-printing machine and the inlet of the downstream dispensing unit 12. The robot system 4, by means of which the 3D plastic windows 1 provided with the electric heat conductor structure are removed from the dispensing unit 12 and placed into the drying furnace 5 in order to be cured, is positioned between the outlet of the dispensing unit 12 and the inlet of the drying furnace 5 arranged in the second processing line. In this case, the drying zone of the drying furnace 5 extends in the second processing line opposite to the transport direction of the first processing line, namely over a total length of 9 m. The depositing station 6, into which the 3D plastic windows 1 with the cured electric heat conductor system are placed, is arranged downstream of the outlet of the drying furnace 5.

Figure 8:
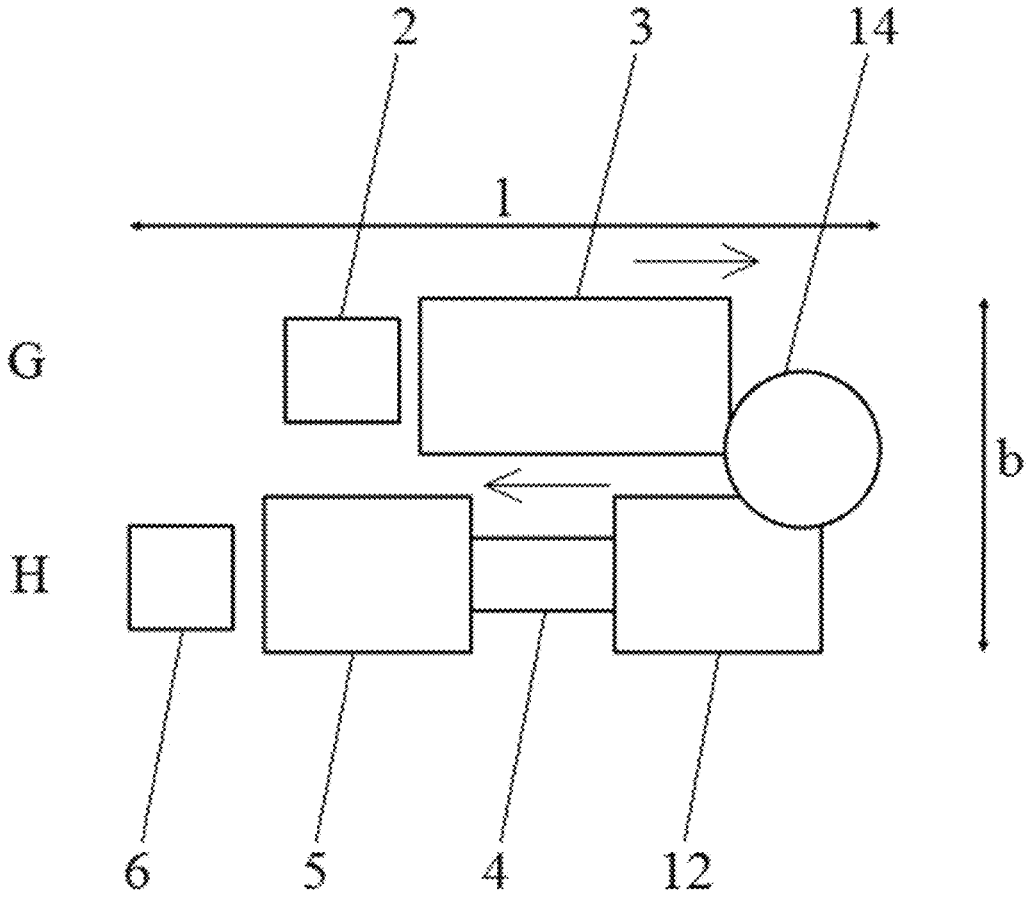
FIG. 8 shows a schematic block diagram of a space-saving embodiment of the system according to the invention, for carrying out the method according to FIG. 6.

FIG. 8 shows a space-saving embodiment of the system for carrying out the method according to FIG. 6, in which the space requirement of the system amounts to approximately 15 m×approximately 10 m. In this case, only the feed unit 2 and the at least one screen-printing machine 3 arranged downstream thereof are provided in the first processing line. The dispensing unit 12, the conveyor or robot system 11 arranged downstream thereof and a downstream paternoster furnace instead of drying furnace 5 in FIG. 7, as well as the depositing station 6 for depositing the finished 3D plastic windows 1 arranged on the outlet side of the paternoster furnace, are positioned in the second processing line, the transport direction of which extends opposite to the transport direction of the first processing line. In addition, the robot system with at least one robot for transporting the 3D plastic windows 1 with the bus bars printed thereon by means of the screen-printing machine 3 to the dispensing unit 12 is positioned between the outlet of the screen-printing machine 3 and the inlet of the dispensing unit 12.

It is to be understood that the embodiments of the invention disclosed are not limited to the particular structures, process steps, or materials disclosed herein, but are extended to equivalents thereof as would be recognized by those ordinarily skilled in the relevant arts. It should also be understood that terminology employed herein is used for the purpose of describing particular embodiments only and is not intended to be limiting.

Reference throughout this specification to one embodiment or an embodiment means that a particular feature, structure, or characteristic described in connection with the embodiment is included in at least one embodiment of the present invention. Thus, appearances of the phrases "in one embodiment" or "in an embodiment" in various places throughout this specification are not necessarily all referring to the same embodiment. Where reference is made to a numerical value using a term such as, for example, about or substantially, the exact numerical value is also disclosed.

As used herein, a plurality of items, structural elements, compositional elements, and/or materials may be presented in a common list for convenience. However, these lists should be construed as though each member of the list is individually identified as a separate and unique member. Thus, no individual member of such list should be construed as a de facto equivalent of any other member of the same list solely based on their presentation in a common group without indications to the contrary. In addition, various embodiments and example of the present invention may be referred to herein along with alternatives for the various components thereof. It is understood that such embodiments, examples, and alternatives are not to be construed as de facto equivalents of one another, but are to be considered as separate and autonomous representations of the present invention.

Furthermore, the described features, structures, or characteristics may be combined in any suitable manner in one or more embodiments. In the following description, numerous specific details are provided, such as examples of lengths, widths, shapes, etc., to provide a thorough understanding of embodiments of the invention. One skilled in the relevant art will recognize, however, that the invention can be practiced without one or more of the specific details, or with other methods, components, materials, etc. In other instances, well-known structures, materials, or operations are not shown or described in detail to avoid obscuring aspects of the invention.

While the forgoing examples are illustrative of the principles of the present invention in one or more particular applications, it will be apparent to those of ordinary skill in the art that numerous modifications in form, usage and details of implementation can be made without the exercise of inventive faculty, and without departing from the principles and concepts of the invention. Accordingly, it is not intended that the invention be limited, except as by the claims set forth below.

The verbs "to comprise" and "to include" are used in this document as open limitations that neither exclude nor require the existence of also un-recited features. The features recited in depending claims are mutually freely combinable unless otherwise explicitly stated. Furthermore, it is to be understood that the use of "a" or "an", that is, a singular form, throughout this document does not exclude a plurality.

LIST OF REFERENCE NUMBERS

1 3D plastic window
2 Feed device
3 Screen-printing machine
4 Removal device
5 Drying furnace, paternoster furnace
6 Depositing station
7 First section of drying zone of drying furnace
8 Second section of drying zone of drying furnace
9 Outlet of drying furnace
10 Squeegee
11 Robot or conveyor system
12 Dispensing unit

The invention claimed is:

1. A method for producing a heating system on a 3D plastic window, said heating system comprising an electric heat conductor structure consisting of at least two bus bars and a grid line pattern with a plurality of grid lines, the method comprising:

a step, in which the at least two bus bars are respectively screen-printed onto the 3D plastic window by at least one displaceable squeegee with screen-printing ink consisting of a first electrically conductive paste;

a step, in which the grid line pattern is applied onto the 3D plastic window such that it respectively overlaps the at least two bus bars with at least one second electrically conductive paste which has a greater electrical resistance than the first electrically conductive paste; and a final step, in which the at least two bus bars and the grid lines overlapping these bus bars are at the respective overlapping points electrically connected into the electric heat conductor structure by electrical connectors, wherein at least one of the grid line pattern and the at least two buss bars are applied onto the 3D plastic window by two squeegees that operate in different directions.

2. The method according to claim 1, wherein the step in which the bus bars are applied onto the 3D plastic window is offset in time in reference to the step in which the grid line pattern is applied onto the 3D plastic window.

3. The method according to claim 1, wherein the step in which the bus bars are applied onto the 3D plastic window is carried out prior to the step in which the grid line pattern is applied onto the 3D plastic window.

4. The method according to claim 1, wherein the step in which the grid line pattern is applied onto the 3D plastic window is carried out prior to the step in which the bus bars are applied onto the 3D plastic window.

5. The method according to claim 1, wherein the grid line pattern is screen-printed onto the 3D plastic window by means of at least one displaceable squeegee.

6. The method according to claim 1, wherein the bus bars are applied onto the 3D plastic window by means of at least one first displaceable squeegee and/or the grid lines of the grid line pattern are applied by means of at least one second displaceable squeegee.

7. The method according to claim 1, wherein at least one of: the grid line pattern and the at least two bus bars are applied onto the 3D plastic window by one squeegee that prints in two directions.

8. The method according to claim 1, wherein the grid line pattern is applied onto the 3D plastic window by means of dispensing.

9. The method according to claim 1, wherein the grid line pattern is applied onto the 3D plastic window by utilizing a digital inkjet printer.

10. The method according to claim 1, wherein the at least two bus bars are applied onto the 3D plastic window by a squeegee that prints in two directions and/or by two squeegees that operate in different directions.

11. The method according to claim 1, wherein the at least two bus bars of the heat conductor structure are simultaneously applied on the left and on the right side of the 3D plastic window in the region of the grid line pattern due to the combination of a feed motion and a rotational motion of the at least one squeegee.

12. The method according to claim 1, wherein the screen-printing of the heat conductor structure consisting of the at least two bus bars and the grid lines overlapping these bus bars is respectively carried out with one of two screens that are used offset in time, wherein the at least two bus bars are applied onto the 3D plastic window along the edges of the latter with the corresponding screen and with separately displaceable squeegees.

13. The method according to claim 1, wherein the two screens, by which the heat conductor structure consisting of the bus bars and the grid lines overlapping these bus bars is screen-printed onto the 3D plastic window, are inserted into an upper unit of a screen-printing machine in succession.

14. The method according to claim 1, wherein two screens, each of which is inserted into the upper unit of the screen-printing machine or guided by a robot or position-controlled for the respective application of one of the at least two bus bars, are used for screen-printing the at least two bus bars of the heat conductor structure to be produced onto the 3D plastic window.

15. The method according to claim 1, wherein the at least one displaceable squeegee used for applying the grid line pattern onto the 3D plastic window is a squeegee that prints in two directions, and starting at the beginning of the first grid line of the grid line pattern, prints the second electrically conductive paste onto the 3D plastic window in the feed direction such that the first grid line of the grid line pattern is formed, wherein the squeegee then carries out a rotational motion after it reaches the end of the first grid line of the grid line pattern referred to the feed direction and subsequently prints the second electrically conductive paste onto the 3D plastic window in the direction extending opposite to the feed direction such that the second grid line of the grid line pattern is formed, wherein this process is repeated until the complete grid line pattern is formed on the 3D plastic window.

16. The method according to claim 1, wherein the at least two bus bars and the grid lines of the grid line pattern are joined at the overlapping points by a conductive adhesive or by soldering.

17. A method for producing a heat conductor system on a 3D plastic window, said heat conductor system comprising an electric heat conductor structure consisting of at least two bus bars and a grid line pattern with a plurality of grid lines, the method comprising:

a step, in which the at least two bus bars and the grid lines of the grid line pattern are respectively screen-printed onto the 3D plastic window such that they overlap one another by means of two squeegees that operate in different directions with screen-printing ink consisting of only one electrically conductive paste; and a subsequent step, in which the at least two bus bars and the grid lines overlapping these bus bars at the respective overlapping points are electrically connected into the electric heat conductor structure by means of electrical connectors.

18. The method according to claim 17, wherein the screen-printing of the at least two bus bars and the grid line pattern with screen-printing ink in the form of the silver paste is carried out continuously by means of a displaceable squeegee capable of printing in opposite directions, wherein this squeegee prints the grid lines of the grid line pattern onto the 3D plastic window starting from the left or the right side with a respective rightward or leftward directed feed motion in a region with less curvature of the 3D plastic window for the grid line pattern, and wherein the feed motion of said squeegee respectively transforms into a rotational and pivoting motion and the squeegee continuously screen-prints one of the two respective bus bars onto the 3D plastic window such that it overlaps the grid lines of the applied grid line pattern in regions with more significant curvature of the 3D plastic window for the two bus bars.

19. The method according to claim 18, wherein the transformations from the feed motion of the at least one squeegee to the rotational and pivoting motion or vice versa are program-controlled.

20. The method according to claim 17, wherein two squeegees, which operate in different directions and the feed motions of which respectively need to be transformed into a rotational and pivoting motion, are used instead of the displaceable squeegee capable of printing in opposite directions.

21. The method according to claim 17, wherein after the respective application of the grid lines of the grid line pattern and/or one of the at least two bus bars, it is ensured that the electrically conductive paste printed onto the 3D plastic window can become touch-dry, preferably by means of self-drying, or is thermally cured by means of IR-radiation or UV-radiation, or by means of heat transmission.

22. A system for carrying out a method for producing a heating system on a 3D plastic window, said heating system comprising an electric heat conductor structure consisting of at least two bus bars and a grid line pattern with a plurality of grid lines, the method comprising:

a step, in which the at least two bus bars are respectively screen-printed onto the 3D plastic window, preferably on the edges of the latter, by means of at least one displaceable squeegee with screen-printing ink consisting of a first electrically conductive paste, preferably a first silver paste, a step, in which the grid line pattern is applied onto the 3D plastic window such that it respectively overlaps the at least two bus bars with at least one second electrically conductive paste, preferably a second silver paste, which has a greater electrical resistance than the first electrically conductive paste, and a final step, in which the at least two bus bars and the grid lines overlapping these bus bars are at the respective overlapping points electrically connected into the electric heat conductor structure by means of electrical connectors wherein at least one of the grid line pattern and the at least two buss bars are applied onto the 3D plastic window by two squeegees that operate in different directions; and the system comprises at least one supply station for cleaned 3D plastic windows, at least one screen-printing machine that is positioned on the outlet side of said supply station and respectively applies the electric heat conductor structure consisting of the two bus bars and the grid line pattern onto the supplied 3D plastic windows, a paternoster furnace that is arranged parallel to the at least one screen-printing machine, a robot station with at least one robot between the outlet of the screen-printing machine and the inlet of the paternoster furnace, wherein the 3D plastic windows with the electric heat conductor structure printed thereon by means of the screen-printing machine are picked up at the outlet of the latter and inserted into the paternoster furnace opposite to the previous processing direction in order to cure the electric conductor structure printed onto the 3D plastic windows, and a depositing station for the 3D plastic windows with cured electric heat conductor structure, which is arranged downstream of the outlet of the paternoster furnace.

23. The system according to claim 22, wherein a dispensing unit is positioned between the robot station and, e.g., the paternoster furnace, wherein the 3D plastic windows, onto which initially only the two respective bus bars of the electric heat conductor structure are printed in the at least one screen printing machine, are inserted into the inlet of said dispensing unit by means of the at least one robot of the robot station, wherein the grid lines of the grid line pattern are in the dispensing unit applied onto each of the 3D plastic windows inserted therein by means of dispensing such that they overlap the respective bus bars, and wherein the 3D plastic windows, which are respectively provided with the complete heat conductor structure, are picked up and transported to the inlet of the paternoster furnace by means of at least one conveyor belt or at least one additional robot that is respectively positioned between the outlet of the dispensing unit and the inlet of the paternoster furnace.

* * * * *